United States Patent [19]

Middlin et al.

[11] Patent Number: 4,840,710

[45] Date of Patent: Jun. 20, 1989

[54] METHOD OF STRIPPING ELECTROLYTICALLY DEPOSITED COPPER FROM A CATHODE

[75] Inventors: Bruce Middlin, Roxby Downs; Norman Locke; Alan W. Kennedy, both of Townsville, all of Australia

[73] Assignee: M.I.M. Technology Marketing Limited, United Kingdom

[21] Appl. No.: 113,074

[22] Filed: Oct. 27, 1987

[30] Foreign Application Priority Data

Nov. 4, 1986 [AU] Australia ..... PH8801

[51] Int. Cl.[4] ..... C25D 1/20

[52] U.S. Cl. ..... 204/12

[58] Field of Search ..... 204/12

[56] References Cited

U.S. PATENT DOCUMENTS

| | | | |
|---|---|---|---|
| 3,533,887 | 10/1970 | Jasberg | 204/12 |
| 3,693,236 | 9/1972 | Kapell | 204/12 |
| 3,953,312 | 4/1976 | Kikkawa | 204/12 |
| 4,177,113 | 12/1979 | Seibt | 204/12 |

FOREIGN PATENT DOCUMENTS

| | | |
|---|---|---|
| 809863 | 7/1974 | Belgium . |
| 1016497 | 8/1977 | Canada . |
| 2451122 | 9/1976 | Fed. Rep. of Germany . |
| 1417259 | 12/1975 | United Kingdom . |

*Primary Examiner*—T. M. Tufariello

*Attorney, Agent, or Firm*—Stevens, Davis, Miller & Mosher

[57] ABSTRACT

Electrolytically deposited copper is stripped from a cathode by first flexing the cathode to cause at least part of the copper deposit to separate from the cathode, and then wedge-stripping or gas-blasting the remainder of the copper from the cathode. Perferably the cathode is a stainless steel sheet, and flexing is achieved by means of hydraulic arms which press the center of the sheet first in one direction and then in the opposite direction. The cathode is supported along its bottom edge and held upright during the process.

8 Claims, 1 Drawing Sheet

METHOD OF STRIPPING ELECTROLYTICALLY DEPOSITED COPPER FROM A CATHODE

FIELD OF INVENTION

This invention relates to a method of stripping electrolytically deposited copper from cathodes used in electrolytic cells.

The invention is applicable to any such cathodes but will be described with particular reference to the cathode described in Australian Pat. No. 506,521. In that patent the cathode is a stainless steel starter sheet which when suspended in the electrolytic bath and connected to a electric source accumulates a copper growth deposit on both sides.

DESCRIPTION OF PRIOR ART

In the prior art after the cathode is removed from the electrolytic bath the copper deposit on the sides of the upper end of the sheet is beaten with pneumatic hammers. This beating causes the copper deposit in that locality to partially separate from the sheet. Then the remainder of the copper deposit is dislodged by the use of nozzled air blasts.

A hammering action has the disadvantages of not only being noise but also, over a period of time, distorting the stainless steel cathode sheet.

SUMMARY OF INVENTION

The invention consists in a method of stripping electrolytically deposited copper from a cathode comprising;

supporting said cathode along its lower edge, flexing said cathode by an amount exceeding the strength of the adhesion bond between the deposited copper and the cathode but not exceeding the elastic limit of the cathode, thereby causing at least part of the deposited copper to separate from the cathode and then wedge-stripping or gas-blasting the deposited copper from the cathode.

BRIEF DESCRIPTION OF DRAWINGS

The invention will now be described by way of example only with reference to the accompanying drawings in which.

DETAILED DESCRIPTION OF INVENTION

Electrolytic deposition of copper onto a stainless steel cathode sheet takes place while the sheet is immersed in an electrolytic bath. The sheet being suspended from a hanger bar which hangs on electrically conductive rails above the electrolytic bath. The purpose of the electrolysis may be either: electro-refining copper by collecting copper ions from impure copper anodes also suspended in the electrolytic bath; or, electro-winning copper ions from an electrolytic bath in which copper has been dissolved, and which contains inert or insoluble anodes, such as lead or lead alloys.

As the electrolysis proceeds a layer of copper is deposited on each side of the stainless steel cathode sheet.

After a period of time the layer of copper increases to a thickness where it is desirable to remove it.

Figure 1:
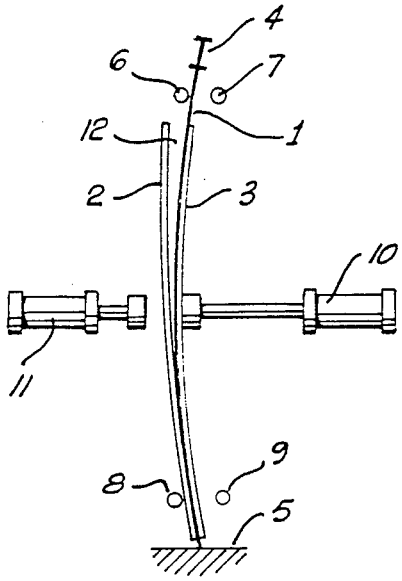
FIG. 1 is a view of one step in a flexing operation embodying the invention.

Referring now to FIG. 1 the stainless steel cathode sheet 1 with its copper deposits 2 and 3 is removed from the electrolytic bath (not shown) and passed to a stripping station. Cathode 1 is not suspended from hanger bar 4 at the stripping station, but is supported on its bottom edge by supporting structure 5, and held substantially vertically between upper-pairs 6 and 7, and lower-pairs 8 and 9 of reaction bars. The cathode is preferably horizontally movable over a series of rollers on the surface of supporting structure 5. Reaction bars 6 and 7 hold an un-coated end of the cathode, while bars 8 and 9 hold a coated end.

By avoiding suspending the sheet from hanger bar 4, during the stripping operation, abrasion of the copper clad electrically contacting ends is prevented. Since the bottom edge of the cathode sheet is recoated with wax before the sheet is re-used abrasion of the bottom edge is of no concern.

Preferably the middle portion of cathode 1 is pressed by one of a pair of hydraulic rams 10 and 11 until the cathode flexes. The head of the ram may make either point contact, line contact or area contact with the sheet. Hydraulic ram 10 flexes the centre of cathode 1 sufficiently to exceed the adhesion bond strength of copper deposit 2 which, as is shown, separates at least from the upper part of the stainless steel sheet at area 12.

Figure 2:
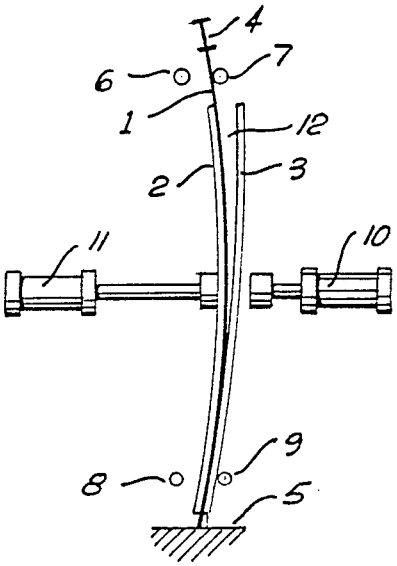
FIG. 2 is a view of a further step in that operation.

Also preferably, as shown in FIG. 2, the other of the pair of hydraulic rams 11 then flexes cathode 1 in the opposite direction to displace the copper deposit 3 from the other side of the cathode.

It is also possible for separation of both deposits 2 and 3 to occur with flexing in only one direction.

Alternatively, as cathode 1 is carried along, the upper and lower ends can be restrained in a series of rollers which as the cathode is moved horizontally will cause the cathode to flex when engaged by a series of rollers positioned in contact near the middle section of the cathode. It should be appreciated that many other methods of flexing a cathode are possible, and all fall within the scope of the invention.

Figure 3:
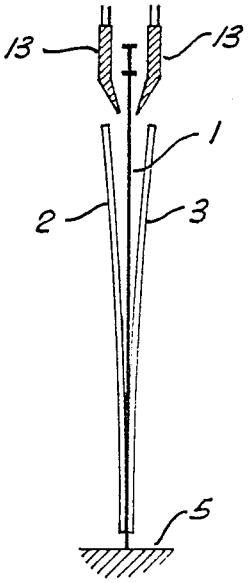
FIG. 3 is a view of a step in a wedge stripping operation embodying the invention.
Figure 4:
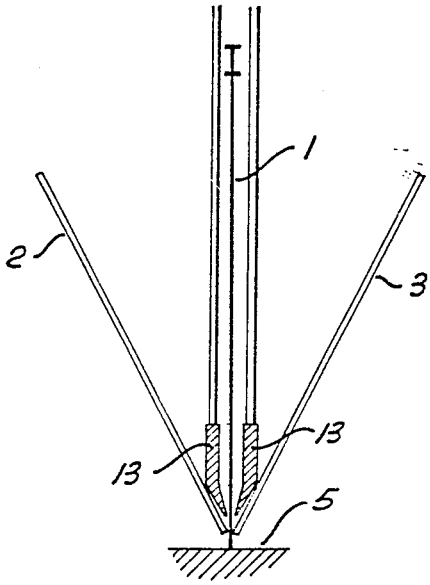
FIG. 4 is a view of a further stage of that wedge stripping operation.

Once the edges of the upper portions of the copper deposits 2 and 3 are separated from cathode 1 a wedge 13, such as is shown in FIG. 3, is forced between each copper deposit 2 and 3 and the cathode 1 to completely separate the copper and the cathode. The copper then falls into a collecting bin. FIG. 4 depicts the final step of the wedge stripping with the wedge 13 at the bottom of cathode 1. Alternatively this can be accomplished by the use of air or other gas blasted from nozzles.

Preferably the hydraulic cylinders on either side of the cathode are operated in such a manner as to be capable of deflecting the cathode over a range of 20 to 30 mm in each direction by pushing at the centre. This is sufficient for the copper to be separated or sheared from the cathode down to the point where the hydraulic ram is pushing. The fact that this release at the top of the cathode is more positive than in the prior art allows an hydraulically operated wedge to be introduced behind the partially released copper growth to facilitate complete stripping. The average stripping rate can, as a consequence, be considerably speeded up. Currently the rate is an average of one sheet being stripped every six seconds.

As will be appreciated by those skilled in the art, the invention can be carried out when the cathode is held in any position other than vertically.

We claim:

1. A method of stripping electrolytically deposited copper from a cathode comprising:

maintaining said cathode in a generally vertical upright position by supporting the cathode along its lower edge not its upper edge;

flexing said cathode by an amount exceeding the strength of the adhesion bond between the deposited copper and the cathode but not exceeding the elastic limit of the cathode, thereby causing at least part of the deposited copper to separate from the cathode and then wedge-stripping or gas-blasting the deposited copper from the cathode.

2. A method according to claim 1 in which the cathode is flexed in oen direction only.

3. A method according to claim 1 in which the cathode is flexed in one direction and then flexed in the opposite direction.

4. A method according to claim 2 in which the cathode is flexed by a hydraulic ram which makes point, line or area contact with the cathode.

5. A method according to claim 3 in which the cathode is flexed by a hydraulic ram which makes point, line or area contact with the cathode.

6. A method according to claim 1 throughout which the cathode is held in said generally vertical upright position by two pairs of reaction bars, one pair on either side of the cathode near its lower edge and the other pair on either side of the cathode near its upper edge.

7. A method as claimed in claim 1 in which the cathode is fabricated from stainless steel.

8. A method according to claim 7 in which the cathode is a sheet of stainless steel.

* * * * *